US009031472B2

(12) United States Patent
Yotsutsuji et al.

(10) Patent No.: US 9,031,472 B2
(45) Date of Patent: May 12, 2015

(54) DEVELOPING DEVICE WITH A DEVELOPER CONVEYING MEMBER HAVING PADDLES CONNECTING SPIRAL BLADES AT ONE CIRCUMFERENTIAL POSITION AND IMAGE FORMING APPARATUS WITH SUCH A DEVELOPING DEVICE

(71) Applicant: KYOCERA Document Solutions Inc., Osaka-shi, Osaka (JP)

(72) Inventors: Takefumi Yotsutsuji, Osaka (JP); Akifumi Yamaguchi, Osaka (JP); Takahisa Nakaue, Osaka (JP); Tamotsu Shimizu, Osaka (JP); Minoru Wada, Osaka (JP); Shizuka Okada, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 14/154,963

(22) Filed: Jan. 14, 2014

(65) Prior Publication Data

US 2014/0205324 A1 Jul. 24, 2014

(30) Foreign Application Priority Data

Jan. 18, 2013 (JP) ..... 2013-007371

(51) Int. Cl.
*G03G 15/18* (2006.01)
*G03G 15/08* (2006.01)

(52) U.S. Cl.
CPC ..... *G03G 15/0893* (2013.01); *G03G 15/0822* (2013.01)

(58) Field of Classification Search
CPC ..... G03G 15/0822; G03G 15/0838; G03G 15/0819; G03G 15/0839; G03G 15/0877; G03G 15/0891; G03G 15/0887; G03G 15/0893; G03G 2215/0827–2215/0833
USPC ..... 399/254, 256
See application file for complete search history.

(56) References Cited

U.S. PATENT DOCUMENTS 5,249,019 A * 9/1993 Ishida et al. ..... 366/318
5,963,766 A * 10/1999 Okuno et al. ..... 399/256
6,526,245 B1 * 2/2003 Yamashita ..... 399/254

(Continued)

FOREIGN PATENT DOCUMENTS

JP 7-13420 1/1995
JP 2010-72149 4/2010

*Primary Examiner* — Billy Lactaoen
*Assistant Examiner* — Arlene Heredia Ocasio
(74) *Attorney, Agent, or Firm* — Gerald E. Hespos; Michael J. Porco; Matthew T. Hespos

(57) ABSTRACT

A developing device includes a housing containing a developer, a developer carrier, a developer conveying path, a developer conveying member, and a plurality of paddle members. The developer conveying path includes a first conveying path and a second conveying path. The developer conveying member is disposed in the second conveying path and includes a rotating shaft and spiral blades formed around the rotating shaft. The developer conveying member is rotationally driven to convey the developer in the second direction and feeds the developer to the developer carrier. The plurality of paddle members project in a radial direction from the rotating shaft of the developer conveying member at one circumferential position on the rotating shaft. The plurality of paddle members is contiguously arranged in the axial direction of the rotating shaft to connect the spiral blades adjacent to each other in the axial direction.

11 Claims, 10 Drawing Sheets

(56) References Cited

U.S. PATENT DOCUMENTS

| | | | | |
|---|---|---|---|---|
| 8,121,523 | B2 * | 2/2012 | Stelter | 399/256 |
| 2004/0213603 | A1 * | 10/2004 | Shigeta et al. | 399/254 |
| 2006/0245792 | A1 * | 11/2006 | Tatsumi et al. | 399/254 |
| 2011/0150537 | A1 * | 6/2011 | Watanabe et al. | 399/256 |
| 2011/0158700 | A1 * | 6/2011 | Iwata | 399/254 |
| 2011/0311279 | A1 * | 12/2011 | Okazaki et al. | 399/254 |
| 2012/0251185 | A1 * | 10/2012 | Matsumoto | 399/258 |
| 2013/0022373 | A1 * | 1/2013 | Bucks et al. | 399/256 |

* cited by examiner

DEVELOPING DEVICE WITH A DEVELOPER CONVEYING MEMBER HAVING PADDLES CONNECTING SPIRAL BLADES AT ONE CIRCUMFERENTIAL POSITION AND IMAGE FORMING APPARATUS WITH SUCH A DEVELOPING DEVICE

The present application is based on Japanese Patent Application No. 2013-007371 filed with the Japanese Patent Office on Jan. 18, 2013, the contents of which is incorporated herein by reference.

BACKGROUND

The present disclosure relates to a developing device for developing an electrostatic latent image formed on an image carrier, and an image forming apparatus including the developing device.

A developing device has been known which is used for an image forming apparatus such as a printer and which develops an electrostatic latent image on an image carrier by developer. Such a developing device has a developer carrier containing a fixed magnet, a layer thickness regulating member that regulates the thickness of a developer layer formed on the developer carrier, and a screw member (developer conveying member) that feeds the developer to the developer carrier. The screw member feeds the developer onto the developer carrier, and the layer thickness regulating member regulates the amount of developer on the developer carrier. In such a configuration, a locally uneven amount of developer fed from the screw member to the developer carrier may lead to a variation in image density or image defects.

An object of the present disclosure is to inhibit image defects caused by the uneven feeding of the developer from the developer conveying member to the developer carrier.

SUMMARY

A developing device according to an aspect of the present disclosure includes a housing, a developer carrier, a developer conveying path, a developer conveying member, and a plurality of paddle members. The housing contains a developer. The developer carrier is arranged in the housing and rotationally driven to carry the developer on a circumferential surface of the developer carrier. The developer conveying path includes a first conveying path and a second conveying path between which the developer is cyclically conveyed. The first conveying path is disposed in the housing away from the developer carrier. The developer is conveyed through the first conveying path in a first direction. The second conveying path is disposed between the first conveying path and the developer carrier along the developer carrier. The developer is conveyed through the second conveying path in a second direction opposite to the first direction. The developer conveying member is disposed in the second conveying path and includes a rotating shaft and spiral blades formed around the rotating shaft at a predetermined pitch in an axial direction of the rotating shaft. Furthermore, the developer conveying member is rotationally driven to convey the developer in the second direction and feeds the developer to the developer carrier. The plurality of paddle members projects in a radial direction from the rotating shaft of the developer conveying member at one circumferential position on the rotating shaft. Additionally, the plurality of paddle members is contiguously arranged in the axial direction of the rotating shaft to connect the spiral blades adjacent to each other in the axial direction.

Furthermore, an image forming apparatus according to another aspect of the present disclosure includes an image carrier, the developing device, and a transfer device. An electrostatic latent image is formed on the image carrier. The image carrier carries a toner image resulting from visualization of the electrostatic latent image with the developer. The developing device feeds the developer to the image carrier. The transfer device transfers the image from the image carrier to a sheet.

DETAILED DESCRIPTION

Figure 1:
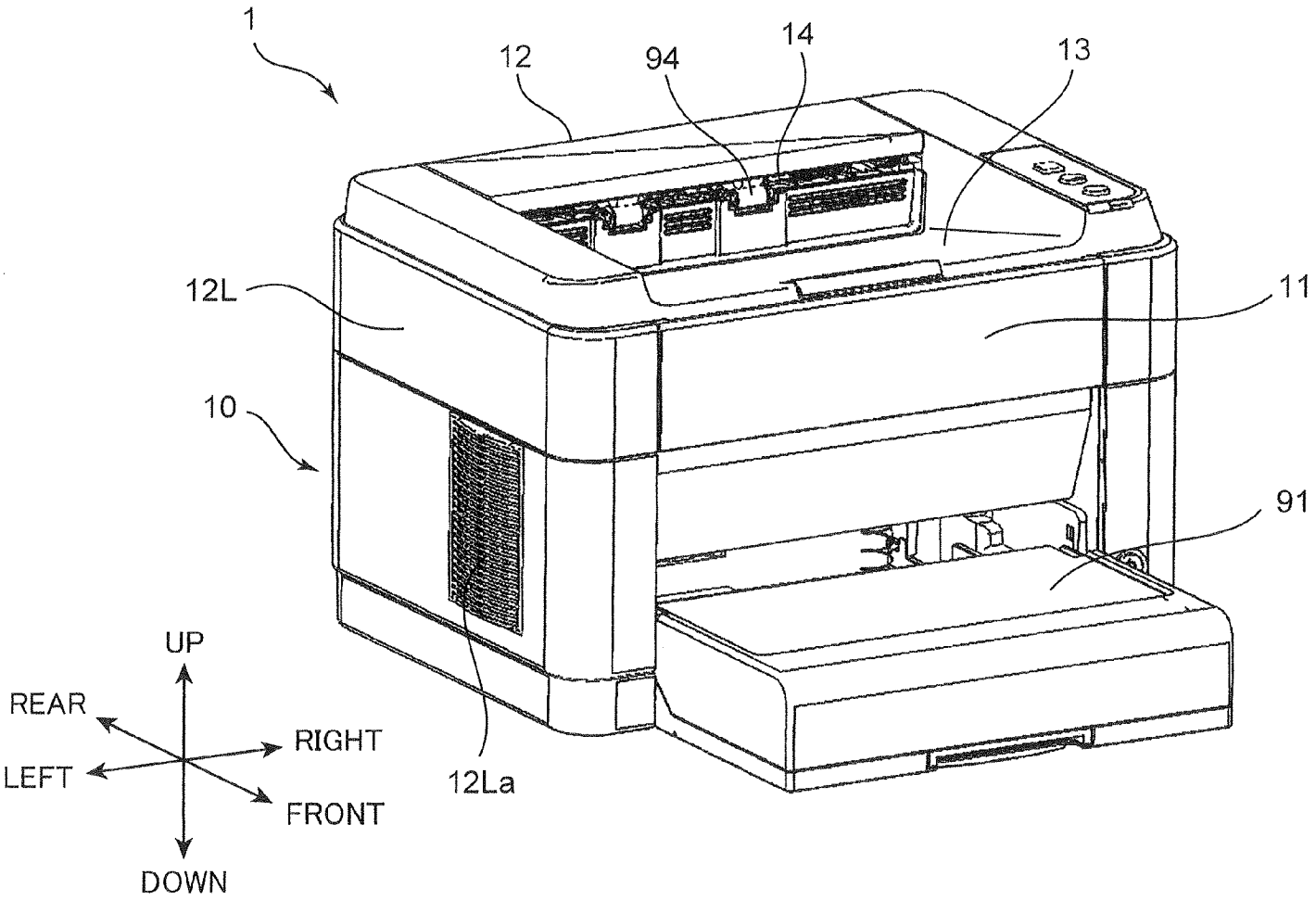
FIG. 1 is a perspective view showing the appearance of an image forming apparatus according to an embodiment of the present disclosure.
Figure 2:
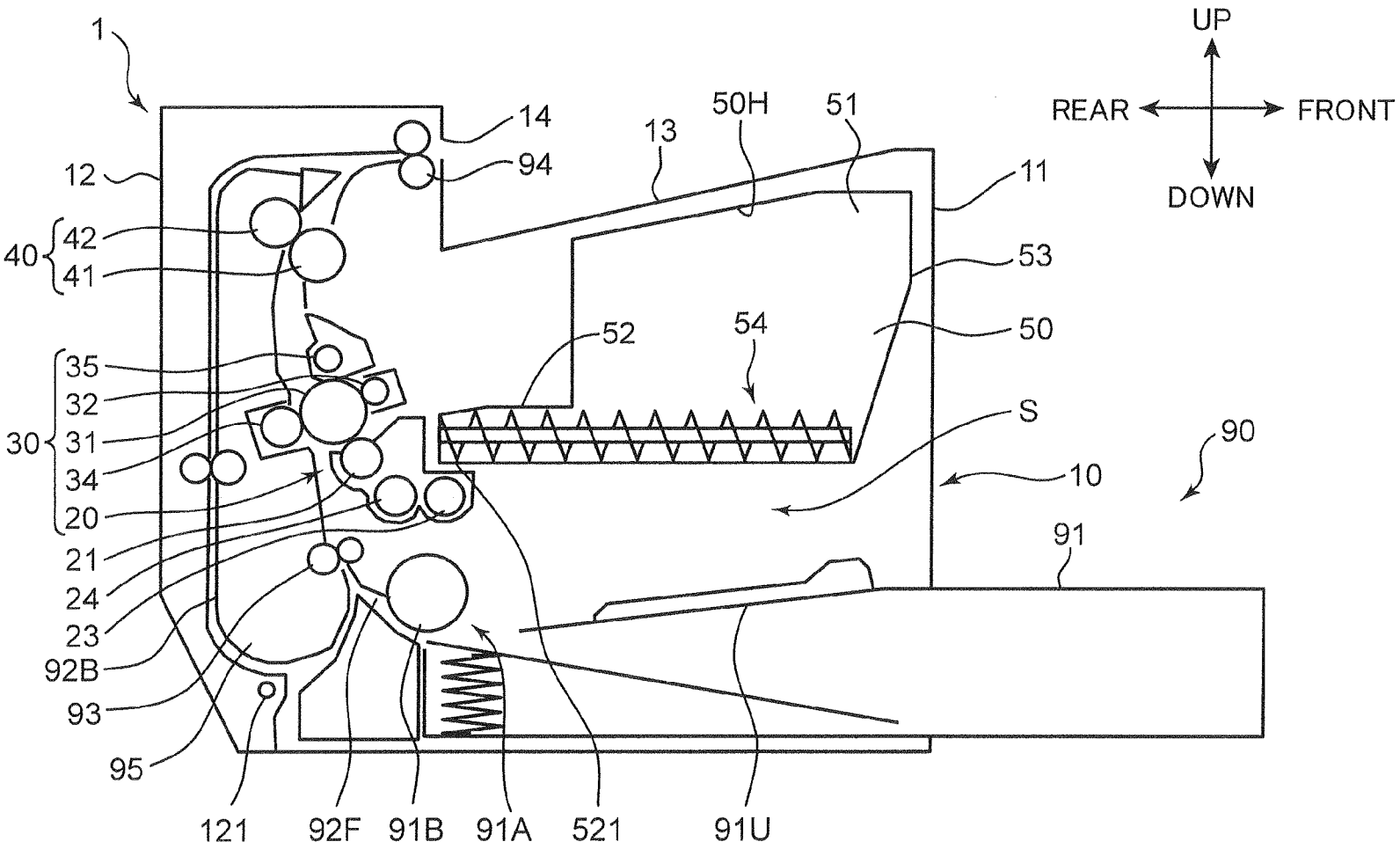
FIG. 2 is a cross-sectional view showing the internal structure of the image forming apparatus according to the embodiment of the present disclosure.

An embodiment of the present disclosure will be described below in detail with reference to the drawings. FIG. 1 is a perspective view showing the appearance of an image forming apparatus 1 according to an embodiment of the present disclosure. Furthermore, FIG. 2 is a side sectional view showing the internal structure of the image forming apparatus 1 according to the embodiment of the present disclosure. A monochromatic printer is illustrated herein as the image forming apparatus 1. However, the image forming apparatus may be a copier, a facsimile apparatus, or a multifunction printer with these functions and may form color images.

The image forming apparatus 1 includes a main body housing 10 with a housing structure shaped generally like a rectangular parallelepiped, an image forming section 30 accommodated in the housing 10, a fixing section 40, a toner container 50, and a sheet feeding section 90.

The main body housing 10 includes a front cover 11 on a front surface side and a rear cover 12 on a rear surface side. Opening the front cover 11 exposes a toner container 50 to the front surface side. This allows a user to remove the toner container 50 from the front surface side of the main body housing 10 when toner is exhausted. The rear cover 12 is opened when a sheet jam occurs or when maintenance work is needed. Each of the units of the image forming section 30 and the fixing section 40 can be removed from the rear surface side of the main body housing 10 by opening the rear cover 12. Furthermore, the main body housing 10 includes a left cover 12L (FIG. 1) disposed on a side surface of the main body housing 10 and a right cover 12R (not shown in FIG. 1) disposed on a side surface of the main body housing 10 and opposite to the left cover 12L, the right cover 12R and the left cover 12L extending in the vertical direction. An intake port 12La is disposed in a front side portion of the left cover 12L to take air into the main body housing 10. Additionally, the main body housing 10 includes a sheet discharge section 13 disposed on an upper surface of the main body housing 10 and into which sheets with images printed thereon are discharged. Various devices for carrying out image formation are installed in an internal space S (FIG. 2) defined by the front cover 11, the rear cover 12, the left cover 12L, the right cover 12R, and the sheet discharge section 13.

The image forming section 30 carries out an image forming process of forming a toner image on a sheet fed out from the sheet feeding section 90. The image forming section 30 includes a photosensitive drum 31 (image carrier), and a charging device 32, an exposure device (not shown in FIG. 2), a developing device 20, a transfer roller 34 (transfer device), and a cleaning device 35, which are arranged around the photosensitive drum 31. The image forming section 30 is disposed between the left cover 12L and the right cover 12R.

The photosensitive drum 31 includes a rotating shaft and a cylindrical surface that rotates around the rotating shaft. An electrostatic latent image is formed on the cylindrical surface, and a toner image corresponding to the electrostatic latent image is carried on the cylindrical surface. The photosensitive drum 31 may be a photosensitive drum formed of a material containing amorphous silicon (a-Si).

The charging device 32 uniformly charges a surface of the photosensitive drum 31 and includes a charging roller that abuts against the photosensitive drum 31.

The cleaning device 35 has a cleaning blade (not shown in the drawings). The cleaning device 35 removes toner attached to a circumferential surface of the photosensitive drum 31 after transfer of a toner image, and conveys the toner to a collection device (not shown in the drawings).

Figure 3:
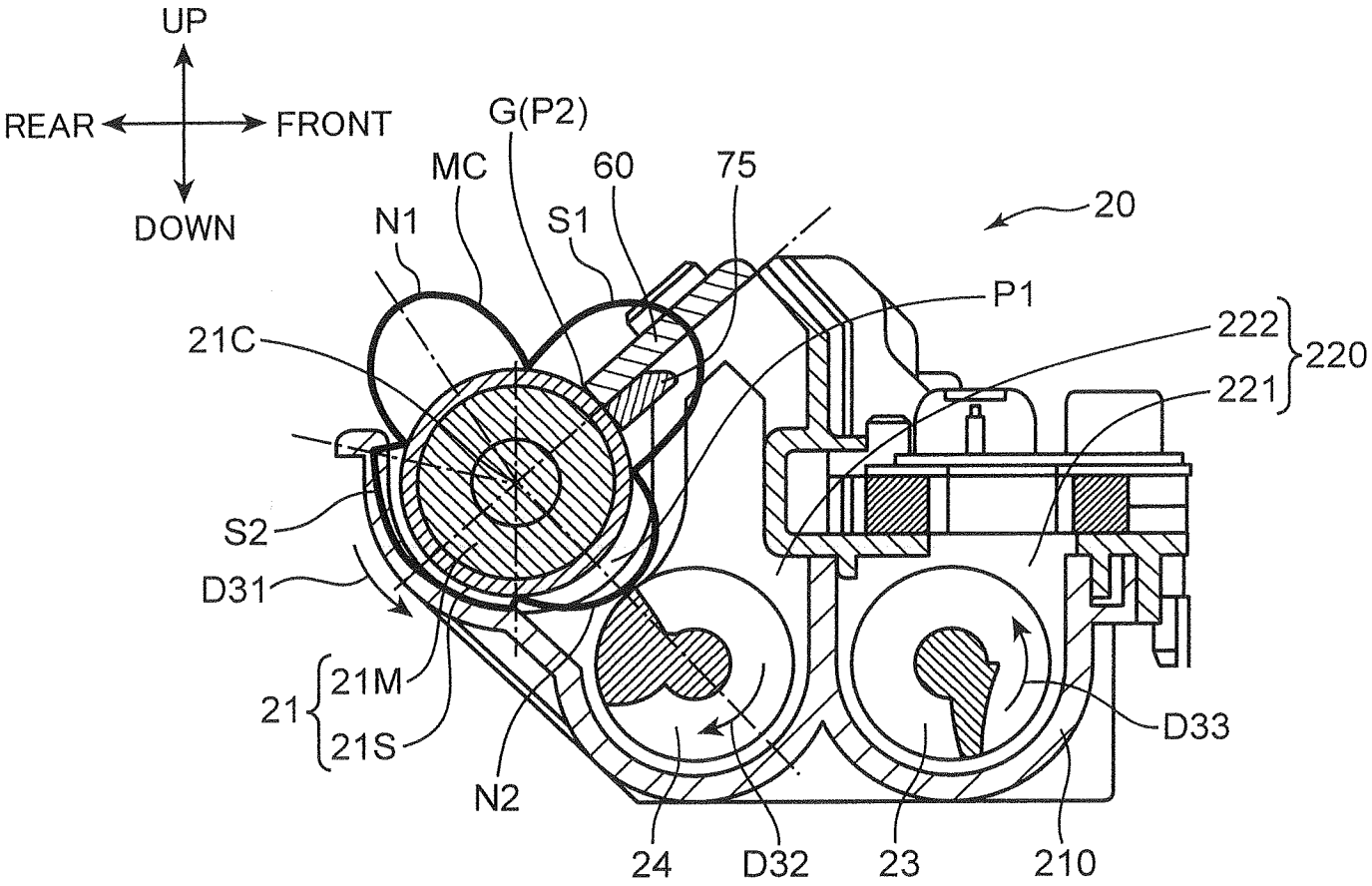
FIG. 3 is a cross-sectional view of a developing device according to an embodiment of the present disclosure.

The exposure device has a laser light source and optical system devices such as mirrors and lenses. The exposure device irradiates the circumferential surface of the photosensitive drum 31 with light modulated based on image data provided by an external apparatus such as a personal computer to form an electrostatic latent image. To develop the electrostatic latent image on the photosensitive drum 31 to form a toner image, the developing device 20 feeds toner to the circumferential surface of the photosensitive drum 31. The developing device 20 includes a developing roller 21 that carries toner to be fed to the photosensitive drum 31, and a first stirring screw 23 and a second stirring screw 24 that cyclically conveys and stirs a developer inside a development housing 210 (FIG. 3). The developing device 20 according to the embodiment will be described below.

The transfer roller 34 is a roller that transfers a toner image formed on the circumferential surface of the photosensitive drum 31 onto a sheet. The transfer roller 34 comes into abutting contact with a cylindrical surface of the photosensitive drum 31 to form a transfer nip portion. The transfer roller 34 is provided with a transfer bias with a polarity opposite to the polarity of the toner.

The fixing section 40 carries out a fixing process of fixing the transferred toner image on a sheet. The fixing section 40 includes a fixing roller 41 containing a heat source and a pressurizing roller 42 compressed against the fixing roller 41 to form a fixing nip portion between the pressuring roller 42 and the fixing roller 41. When the sheet with the toner image transferred thereto is passed through the fixing nip portion, the toner image is heated by the fixing roller 41 and pressed by the pressurizing roller 42 and thus fixed on the sheet.

The toner container 50 (developer container) stores toner to be fed to the developing device 20. The toner container 50 includes a container main body 51 serving as a main storage area for toner, a cylindrical portion 52 that projects from a lower portion of one side surface of the container main body 51, a cover member 53 that covers another side surface of the container main body 51, and a rotating member 54 accommodated inside the container to convey the toner. When the rotating member 54 is rotationally driven, the toner stored in the container 50 is fed into the developing device 20 through a toner discharge port 521 (developer discharge port) provided in a lower surface of a leading end of the cylindrical portion 52. Furthermore, a container top plate 50H that covers a top portion of the toner container 50 is positioned below the sheet discharge section 13 (see FIG. 2).

The sheet feeding section 90 includes a sheet feeding cassette 91 that accommodates sheets on which an image forming process is to be carried out (FIG. 2). The sheet feeding cassette 91 partly projects further forward from the front surface of the main body housing 10. An upper surface of a portion of the sheet feeding cassette 91 accommodated in the main body housing 10 is covered by a sheet feeding cassette top plate 91U. The sheet feeding cassette 91 includes a sheet accommodating space in which a bundle of sheets is accommodated and a lift plate that lifts the bundle of sheets up for sheet feeding. The sheet feeding cassette 91 includes a sheet feed section 91A provided above a rear end of the sheet feeding cassette 91. The sheet feed section 91A includes a sheet feeding roller 91B that feeds the uppermost sheet of the bundle of sheets in the sheet feeding cassette 91 one at a time.

The main body housing 10 contains a main conveying path 92F and an inversion conveying path 92B through which sheets are conveyed. The main conveying path 92F extends from the sheet feed section 91A of the sheet feeding section 90 via the image forming section 30 and the fixing section 40 to a sheet discharge port 14 provided opposite the sheet discharge section 13 on the upper surface of the main body housing 10. The inversion conveying path 92B is a conveying path through which, when a sheet is to be printed on both sides thereof, the sheet printed on one side thereof is returned to an upstream side of the image forming section 30 in the main conveying path 92F.

The main conveying path 92F extends so as to pass through the transfer nip portion formed by the photosensitive drum 31 and the transfer roller 34, from below to above the transfer nip portion. Furthermore, the main conveying path 92F includes a pair of registration rollers 93 arranged upstream of the transfer nip portion. A sheet is temporarily stopped by the pair of registration rollers 93, undergoes skew correction, and is then conveyed to the transfer nip portion at a predetermined timing for image transfer. A plurality of conveying rollers for conveying sheets is arranged at appropriate positions in the main conveying path 92F and the inversion conveying path 92B. For example, a pair of sheet discharge rollers 94 is arranged in the vicinity of the sheet discharge port 14.

The inversion conveying path 92B is formed between an outer side surface of an inversion unit 95 and an inner surface of the rear cover 12 of the main body housing 10. The inversion unit 95 includes the transfer roller 34 and one roller of the pair of registration rollers 93 mounted on an inner side surface of the inversion unit 95. The rear cover 12 and the inversion unit 95 are each rotationally movable around an axis of a supporting point potion 121 provided at a lower end of the rear cover 12 and the inversion unit 95. If a sheet jam occurs in the inversion conveying path 92B, the rear cover 12 is opened. If a sheet jam occurs in the main conveying path 92F or a unit of the photosensitive drum 31 or the developing device 20 is taken out of the apparatus, not only the rear cover 12 but the inversion unit 95 is opened.

<Description of the Developing Device>

Figure 4:
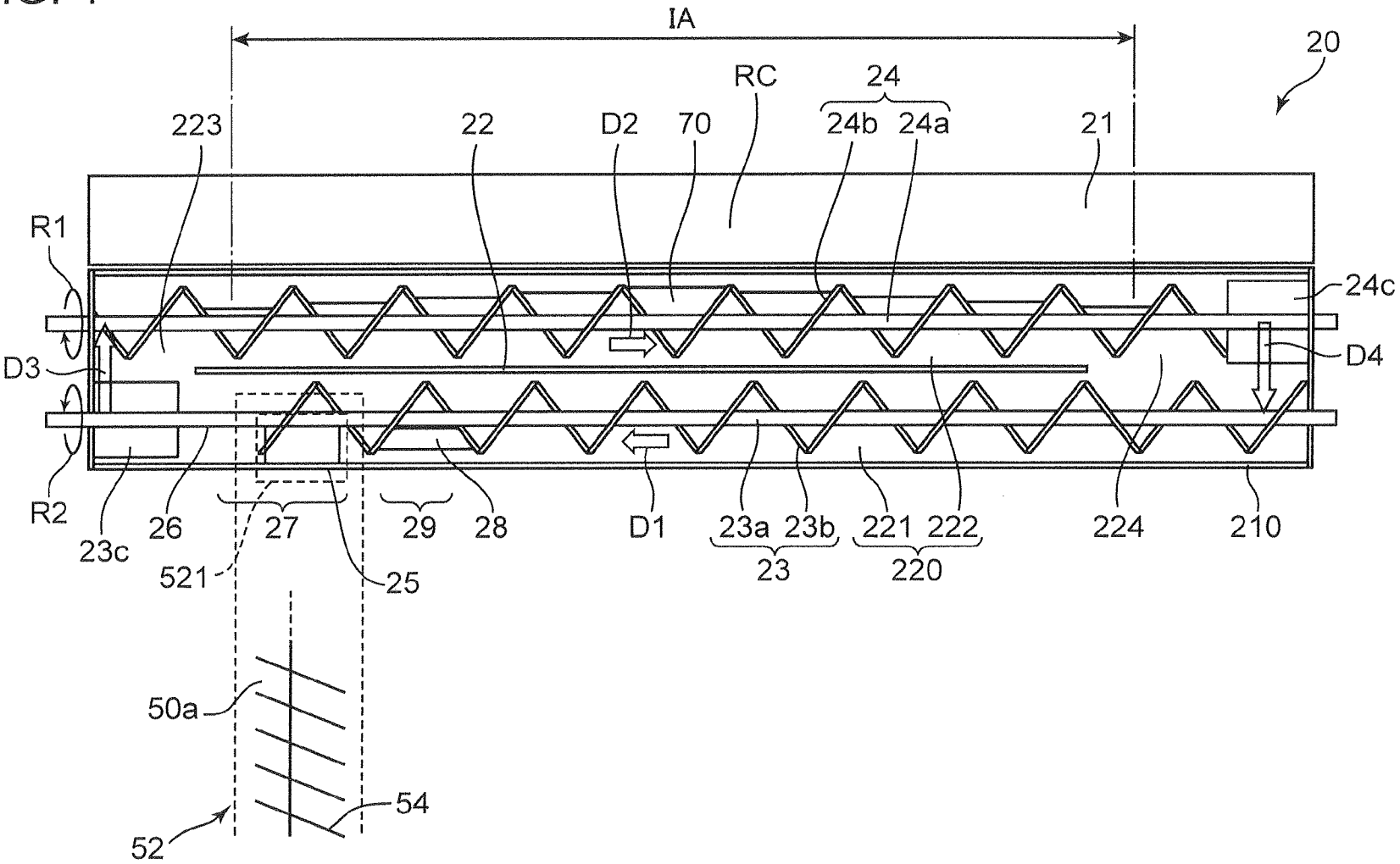
FIG. 4 is a plan view of the developing device according to the embodiment of the present disclosure.

Now, the developing device 20 according to a first embodiment of the present disclosure will be described. FIG. 3 is a cross-sectional view showing the internal structure of the developing device 20. Furthermore, FIG. 4 is a plan view showing the internal structure of the developing device 20. The developing device 20 includes the development housing 210 (housing) shaped like a box that is elongate in one direction (an axial direction of the developing roller 21). The development housing 210 contains a developer. The development housing 210 has an internal space 220. The internal space 220 includes the developing roller 21 (developer carrier), the first stirring screw 23 and the second stirring screw 24 (developer conveying members), and a toner supply port 25 (developer supply port) all disposed therein. The first embodiment uses a magnetic one-component development scheme in which toner containing a magnetic material is filled in the internal space 220 as a developer (magnetic one-component developer). The toner is stirred and conveyed in the internal space 220 and sequentially fed from the developing roller 21 to the photosensitive drum 31 in order to develop an electrostatic latent image. According to other embodiments, the development housing 210 may contain a two-component developer containing toner and a carrier.

The developing roller 21 is rotationally driven and carries toner on a circumferential surface thereof. The developing roller 21 is shaped like a cylinder extending in a longitudinal direction of the development housing 210. The developing roller 21 includes a rotationally driven cylindrical sleeve 21S and a columnar magnet 21M fixedly arranged inside the sleeve 21S along the axial direction of the developing roller 21. The sleeve 21S is rotationally driven in the direction of arrow D31 in FIG. 3 by a drive mechanism (not shown in the drawings). The sleeve 21S carries magnetic toner on a circumferential surface thereof. The magnet 21M is a fixed magnet provided inside the sleeve 21S and having a plurality of magnetic poles arranged in a circumferential direction of the sleeve 21S. The magnet 21M includes four circumferentially arranged magnetic poles, an S1 pole, an N1 pole, an S2 pole, and an N2 pole. In FIG. 3, a curve MC surrounding the developing roller 21 shows radial magnetic forces of the developing roller 21 generated by the respective magnetic poles, as a circumferential distribution on the sleeve 21S. The S1 pole is arranged at an upper front position on the magnet 21M. The S1 pole is used as a regulating pole to regulate a toner layer. The N1 pole is arranged at an upper rear position on the magnet 21M. The N1 pole functions as a developing pole to feed toner to the photosensitive drum 31. The N2 pole is arranged at a lower front position on the magnet 21M. The N2 pole functions as a catch pole to pump the toner up onto the developing roller 21. The S2 pole is arranged at a position on the magnet 21M which is downstream of the N1 pole and upstream of the N2 pole in a rotating direction of the sleeve 21S. The S2 pole is mostly arranged at a lower rear position on the magnet 21M. The S2 pole functions as a conveying pole to collect toner having failed, in the N1 pole, to be moved to the photosensitive drum 31 side in the development housing 210. The toner carried on the sleeve 21S is conveyed to an opening (not shown in the drawings) disposed in the development housing 210 and fed to the photosensitive drum 31, located opposite the opening.

The internal space 220 in the development housing 210 is covered by a top plate (not shown in the drawings) and partitioned into a first conveying path 221 and a second conveying path 222 which are elongate in the lateral direction, by a partition plate 22 extending in a lateral direction of the development housing 210. The first conveying path 221 is disposed in the development housing 210 away from the developing roller 21. The developer is conveyed through the first conveying path 221 in a first direction (the direction of arrow D1 in FIG. 4). The second conveying path 222 is disposed between the first conveying path 221 and the developing roller 21 along the developing roller 21. The developer is conveyed through the second conveying path 222 in a second direction (the direction of arrow D2 in FIG. 4) opposite to the first direction. The partition plate 22 is shorter than the lateral width of the development housing 210. The internal space 220 includes a first communication path 223 and a second communication path 224 arranged at a left end and a right end, respectively, of the partition plate 22 so that each of the communication paths 223 and 224 allows the first conveying path 221 and the second conveying path 222 to communicate with each other. In the first communication path 223, toner is delivered from the first conveying path 221 to the second conveying path 222. Furthermore, in the second communication path 224, toner is delivered from the second conveying path 222 to the first conveying path 221. Thus, in the internal space 220, a circulation path (developer conveying path) is formed which leads to the first conveying path 221, the first communication path 223, the second conveying path 222, and the second communication path 224. Between the first conveying path 221 and the second conveying path 222, the toner is cyclically conveyed through the circulation path in a clockwise direction in FIG. 4.

The toner supply port 25 is an opening drilled in the top plate and arranged near and above the left end of the first conveying path 221 (FIG. 4). The toner supply port 25 is arranged opposite the circulation path and has a function to load supply toner fed from the toner container 50 into the internal space 220. According to the first embodiment, the toner supply port 25 is an opening that is 14 mm×8 mm in a plan view.

The first stirring screw 23 is disposed in the first conveying path 221. The first stirring screw 23 includes a first rotating shaft 23*a* and a first spiral blade 23*b* spirally projecting from a circumference of the first rotating shaft 23*a*. The first stirring screw 23 is rotationally driven around the first rotating shaft 23*a* (arrow D33 in FIG. 3 and arrow R2 in FIG. 4) by a drive mechanism (not shown in the drawings) to convey toner in the direction of arrow D1 in FIG. 4 (first direction). The first stirring screw 23 conveys the developer so as to allow the developer to pass through a position where the toner supply port 25 lies opposite the first conveying path 221. Thus, the first stirring screw 23 has a function to mix new toner flowing in through the toner supply port 25 with toner conveyed through the first conveying path 221 to deliver the mixed toner to the second conveying path 222 side. According to the first embodiment, the first spiral blade 23*b* has an outer diameter of 14 mm and an axial pitch set to 20 mm. The pitch is changeable according to conveying performance of the first stirring screw 23. However, the lower limit of the pitch is preferably set to 15 mm in order to maintain the toner conveying capability of the first stirring screw 23. A first paddle 23*c* is disposed on a downstream side of the first stirring screw 23 in the toner conveying direction (D1 direction). The first paddle 23*c* is a plate-like member disposed on the first rotating shaft 23*a*. The first paddle 23*c* is rotated along with the first rotating shaft 23*a* to deliver the toner in the direction of arrow D3 in FIG. 4 from the first conveying path 221 to the second conveying path 222. According to the first embodiment, the first paddle 23*c* has an axial length set to 20 mm.

The second stirring screw 24 is disposed in the second conveying path 222. The second stirring screw 24 includes a second rotating shaft 24*a* (rotating shaft) and a second spiral blade 24*b* (spiral blade) spirally projecting from a circumference of the second rotating shaft 24*a*. In other words, the second spiral blade 24*b* is a spiral blade formed around the second rotating shaft 24*a* at a predetermined pitch in an axial direction of the second rotating shaft 24*a*. The second stirring screw 24 is rotationally driven around the second rotating shaft 24*a* (arrow D32 in FIG. 3 and arrow R1 in FIG. 4) by a drive mechanism (not shown in the drawings) to convey toner in the direction of arrow D2 in FIG. 4 (second direction). The second stirring screw 24 conveys the toner through the second conveying path 222 and feeds the toner to the developing roller 21. According to the first embodiment, the second spiral blade 24*b* has an outer diameter of 14 mm and an axial pitch set to 20 mm. The pitch is changeable according to conveying performance of the second stirring screw 24. However, the lower limit of the pitch is preferably set to 15 mm in order to maintain the toner conveying capability.

The second stirring screw 24 is arranged in front of and below the developing roller 21. That is, the second stirring screw 24 is arranged opposite the N2 pole of the magnet 21M. The toner is fed from the second stirring screw 24 to the sleeve 21S in conjunction with rotation (arrow D32 in FIG. 3) of the second stirring screw 24. The rotating shaft 24*a* of the second stirring screw 24 is positioned below the rotating shaft of the sleeve 21S. Moreover, the rotating shaft 24*a* of the second stirring screw 24 is positioned below a lower end portion of the circumferential surface of the sleeve 21S. According to the first embodiment, a path through which the toner is fed to the developing roller 21 is formed only by a path through which the toner is fed from the second stirring screw 24. The second stirring screw 24 pumps up the toner from below the developing roller 21 to feed the toner to the sleeve 21S.

A second paddle 24*c* is disposed on a downstream side of the second stirring screw 24 in the toner conveying direction (the direction of arrow D2). The second paddle 24*c* is a plate-like member disposed on the second rotating shaft 24*a*. The second paddle 24*c* is rotated along with the second rotating shaft 24*a* to deliver toner in the direction of arrow D4 in FIG. 4 from the second conveying path 222 to the first conveying path 221. According to the first embodiment, the second paddle 24*c* has an axial length set to 20 mm.

The developing device 20 further includes a layer regulating member 60 and a magnet plate 75. The layer regulating member 60 is arranged in front of and above the developing roller 21. The layer regulating member 60 is arranged along an axial direction of the developing roller 21 and opposite the circumferential surface of the developing roller 21 (sleeve 21S). Specifically, the layer regulating member 60 is arranged opposite the S1 pole of the magnet 21M in the developing roller 21. The layer regulating member 60 is a plate-like member formed of a magnetic material. The layer regulating member 60 has a rectangular shape with long sides extending toward the developing roller 21, in a cross section orthogonal to the axis of rotation of the developing roller 21. A leading end portion of the layer regulating member 60 is arranged away from the sleeve 21S of the developing roller 21. As a result, a layer regulating gap G is formed between the leading end portion and the sleeve 21S. The layer regulating member 60 regulates the layer thickness of toner pumped up from the second stirring screw 24 onto the sleeve 21S.

The magnet plate 75 is arranged in front of and along the layer regulating member 60. In other words, the magnet plate 75 is arranged upstream of the layer regulating member 60 in the rotating direction (arrow D31 in FIG. 3) of the sleeve 21S of the developing roller 21. According to the present embodiment, the magnet plate 75 is formed of a permanent magnet shaped like a plate. The magnet plate 75 has a generally rectangular shape with long sides extending along the layer regulating member 60, in a cross section orthogonal to the axis of rotation of the developing roller 21. The magnet plate 75 is fixed to a lower portion of the layer regulating member 60. The magnet plate 75 has a magnetic force with an S polarity, which is the same as the polarity of the S1 pole of the magnet 21M, at a position opposite to the S1 pole. Furthermore, the magnet plate 75 includes an N pole located at a longer distance from the S1 pole of the magnet 21M than the S pole.

Thus, according to the embodiment, the magnet plate 75 is arranged upstream of the layer regulating member 60 in the rotating direction of the developing roller 21 (sleeve 21S). In other words, the magnet plate 75 and the layer regulating member 60 are arranged in order from the upstream side to the downstream side in the rotating direction of the developing roller 21 and opposite the circumferential surface of the developing roller 21.

Thus, according to the first embodiment, the second stirring screw 24 feeds toner to the sleeve 21S by feeding the toner toward a first position P1 on the circumferential surface of the sleeve 21S which faces downward in the vertical direction. Furthermore, the layer regulating member 60 regulates the thickness of the toner on the sleeve 21S at a second position P2 on the circumferential surface of the sleeve 21S which faces upward in the vertical direction and which lies above the first position P1. In this case, the S1 pole of the magnet 21M and the S pole of the magnet plate 75 have a magnetic force of the same polarity, and thus, a repulsive magnetic field acts between the sleeve 21S and the magnet plate 75. The repulsive magnetic field is classified into a magnetic field acting toward an upstream side of the sleeve 21S in the rotating direction thereof a magnetic field acting toward a downstream side of the sleeve 21S in the rotating direction thereof (toward the layer regulating member 60 side). As a result, a force traveling along the circumferential surface of the sleeve 21S is applied to the toner conveyed on the sleeve 21S and entering a lower portion of the magnet plate 75. As a result, regulation of the toner layer is achieved by the regulation of thinning the toner layer. Moreover, toner having failed to enter a layer regulating gap G in the layer regulating member 60 is urged by the repulsive magnetic field to flow toward the upstream side of the sleeve 21S in the rotating direction thereof.

<Stagnant Portion>

As shown in FIG. 4, the toner container 50 is arranged above the toner supply port 25 in the development housing 210. The toner container 50 includes a toner conveying path 50*a* through which toner is conveyed, a rotating member 54, and a toner discharge port 521. The toner container 50 is assembled in the developing device 20 so that the longitudinal direction of the toner container 50 (the direction in which the toner conveying path 50*a* is formed) is positioned orthogonally to a longitudinal direction of the developing device 20 (the direction in which the first stirring screw 23 conveys the developer; the direction of arrow D1).

The toner discharge port 521 is disposed at a bottom portion of the toner container 50 in association with the toner supply port 25 in the developing device 20. The rotating member 54 has a shaft portion and a blade portion rotated around the shaft portion (see FIG. 2). The rotating member 54 conveys supply toner in the toner conveying path 50*a* toward the toner discharge port 521. The toner having fallen through the toner discharge port 521 is supplied to the developing device 20 via the toner supply port 25.

Figure 5:
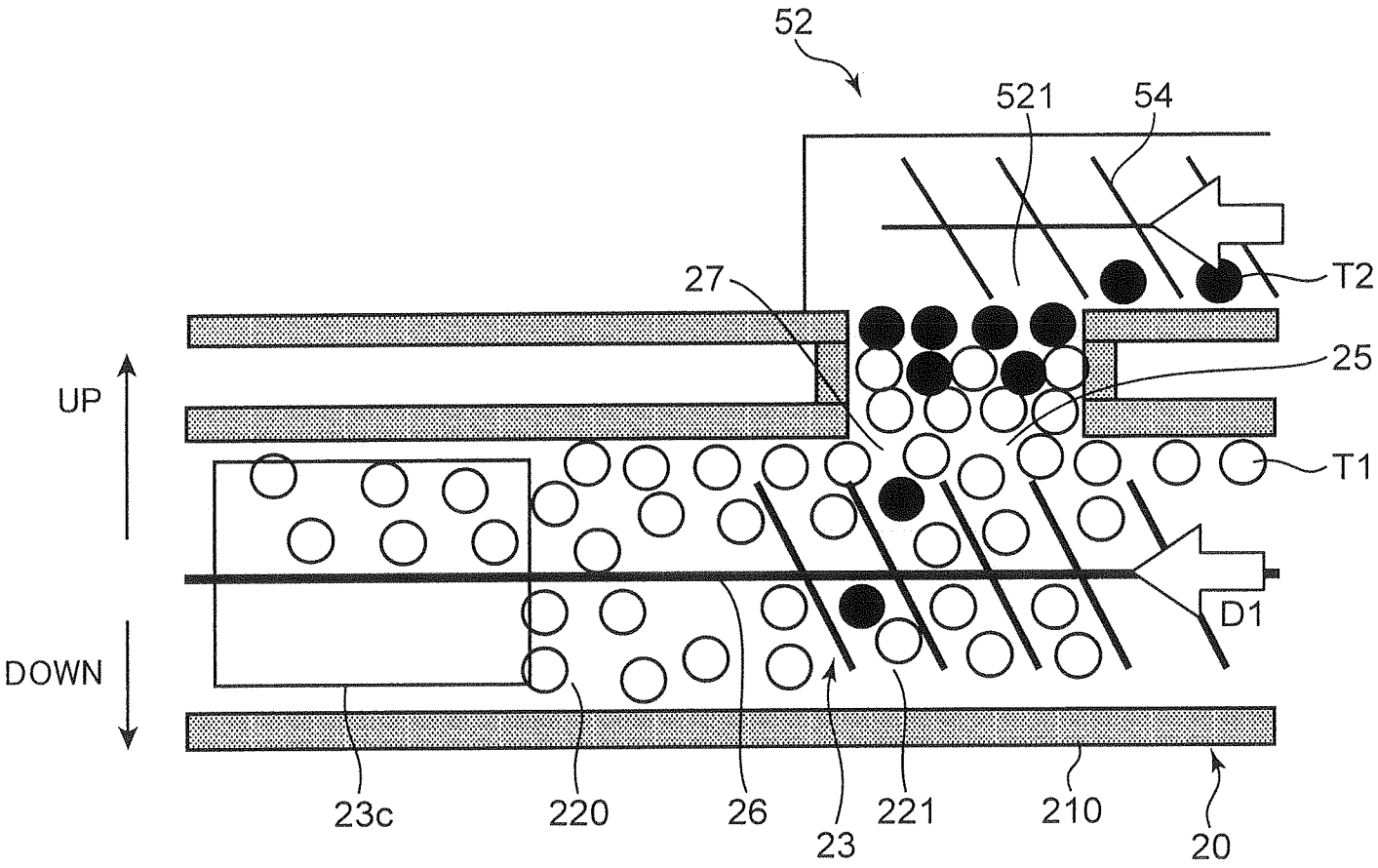
FIG. 5 is a schematic diagram showing how toner is supplied to the developing device according to the embodiment of the present disclosure.

Now, a flow of toner newly supplied to the development housing 210 through the toner supply port 25 will be described. FIG. 5 is a cross-sectional view of the vicinity of the toner supply port 25 disposed in the developing device 20 and the toner discharge port 521 disposed in the toner container 50. In FIG. 5, the arrangement of the toner container 50 has been rotated through 90 degrees in the horizontal direction for description. In actuality, the rotating member 54 in the toner container 50 extends toward the reader, and the first stirring screw 23 and the rotating member 54 in the toner container 50 have an orthogonal positional relation.

Supply toner T2 fed through the toner discharge port 521 in the toner container 50 falls into the first conveying path 221 and mixes with existing toner T1. The first stirring screw 23 conveys the mixture in the direction of arrow D1. At this time, the toners T1 and T2 are stirred and charged.

The first stirring screw 23 includes a conveying capability suppressing section 26 provided downstream of the toner supply port 25 in the toner conveying direction to partly suppress development conveying performance. According to the first embodiment, the conveying capability suppressing section 26 is formed by eliminating the corresponding portion of the first spiral blade 23*b* of the first stirring screw 23. According to the first embodiment, the conveying capability suppressing section 26 has an axial length set to 12 mm. In other words, the conveying capability suppressing section 26 corresponds to a portion of the first stirring screw 23 in which only the first rotating shaft 23*a* is disposed. In this case, the conveying capability suppressing section 26 fails to have developer conveying performance in an axial direction of the first rotating shaft 23*a*. Thus, in the first conveying path 221, toner conveyed from an upstream side of the conveying capability suppressing section 26 starts to stagnate at the conveying capability suppressing section 26. The stagnation of the toner accumulates to a position located immediately upstream of the conveying capability suppressing section 26 and at which the toner supply port 25 lies opposite the first conveying path 221. As a result, a stagnant portion 27 in which the developer stagnates is formed near an inlet of the toner supply port 25.

When the supply toner T2 is fed through the toner supply port 25 to increase the amount of toner in the internal space 220, the toner stagnating in the stagnant portion 27 blocks (seals) the toner supply port 25 to suppress further supply of the toner. Subsequently, when the toner in the internal space 220 is consumed from the developing roller 21 to reduce the toner stagnating in the stagnant portion 27, the toner blocking the toner supply port 25 is reduced to form a gap between the stagnant portion 27 and the toner supply port 25. As a result, the supply toner T2 flows into the internal space 220 again from the toner supply port 25. As described above, the first embodiment adopts a volume-supply toner supply form in which the amount of loaded supply toner is adjusted according to a decrease in the amount of toner stagnating in the stagnant portion 27. According to another embodiment, toner from the toner container 50 may be supplied to the development housing 210 in accordance with an output from a toner sensor (not shown in the drawings) arranged in the development housing 210.

Figure 6:
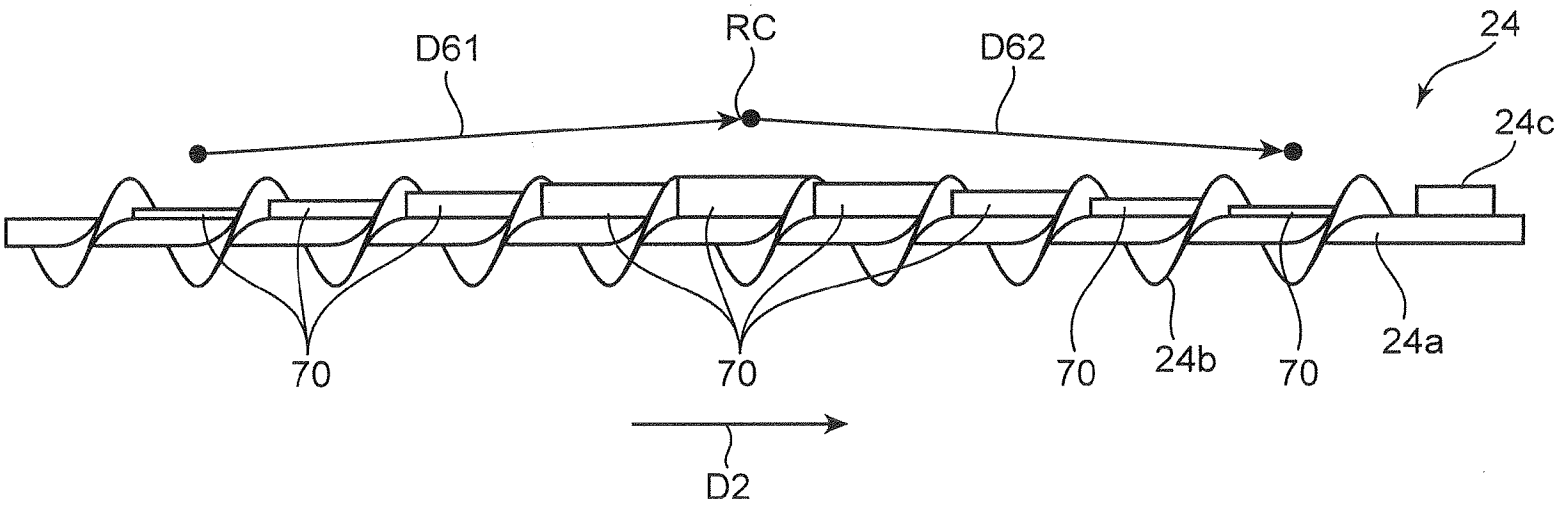
FIG. 6 is plan view of a first stirring screw in the developing device according to the embodiment of the present disclosure.

Moreover, according to the first embodiment, the second stirring screw 24 includes feeding paddles 70. FIG. 6 is a plan view of the second stirring screw 24. As shown in FIG. 4 and FIG. 6, the feeding paddles 70 are a plurality of plate-like members (paddle members) projecting in a radial direction from the second rotating shaft 24*a* of the second stirring screw 24 at one circumferential position on the rotating shaft 24*a*. The maximum range of projection of the feeding paddles 70 project is from the rotating shaft 24*a* to the vicinity of an outer periphery of the second spiral blade 24*b*. Furthermore, the feeding paddles 70 are a plurality of plate-like members contiguously arranged so as to cover at least an axial area of the rotating shaft 24*a* corresponding to an image formation area IA of the developing roller 21 and connecting the axially adjacent spiral blades of the second spiral blade 24*b* together. The image formation area IA of the developing roller 21 corresponds to an axial area on the developing roller 21 which enables the corresponding electrostatic latent image to be formed on the photosensitive drum 31. The area also corresponds to the maximum image area that allows the corresponding image to be formed on a sheet. The adjacent spiral blades thus connected together by the feeding paddles 70 inhibit a variation in the amount of toner fed to the developing roller 21 between a portion of the second stirring screw 24 with the spiral blade of the second spiral blade 24*b* and a portion of the second stirring screw 24 without the spiral blade of the second spiral blade 24*b*. Moreover, the arrangement of the feeding paddles 70 relatively reduces the conveying performance of the second stirring screw 24 in the second direction, increasing the amount of toner stored in the second conveying path 222. Additionally, since the plurality of feeding paddles 70 is arranged at the one circumferential surface, this configuration suppresses excessive degradation of the axial conveying performance of the second stirring screw 24 compared to a configuration in which a plurality of paddle members is arranged in the circumferential direction. Therefore, the toner is stably fed to the developing roller 21 along the second direction.

Moreover, according to the present embodiment, a height to which the plurality of feeding paddles 70 projects from the rotating shaft 24*a* in the radial direction gradually increases within a range from the first communication path 223 to an axially central portion RC of the developing roller 21, as shown in FIG. 4 to FIG. 6 (see arrow D61in FIG. 6). That is, outer edges of the individual feeding paddles 70 extend parallel to one another in the axial direction of the rotating shaft 24*a*. The height of the feeding paddles 70 arranged between the spiral blades gradually increases from a conveying-directional upstream side of the second stirring screw 24 to the axially central portion RC of the developing roller 21. As a result, the projection height of the feeding paddles 70 is set smaller at an upstream end portion of the second conveying path 222 to maintain high axial conveying performance. Thus, toner having flowed from the first communication path 223 into the second conveying path 222 is quickly conveyed to the central portion of the developing roller 21. In other words, the toner is inhibited from excessively stagnating on an upstream side of the second conveying path 222 in the conveying direction thereof. Within the range from the first communication path 223 to the axially central portion RC of the developing roller 21, the feeding paddles 70 are configured as follows. The height to which one of the plurality of feeding paddles located closest to the first communication path 223 projects in the radial direction from the rotating shaft 24*a* is set equal to a first height. The height of the feeding paddle 70 located closest to the central portion RC is set equal to a second height larger than the first height. The height of the plurality of feeding paddles 70 is set to gradually increase from the first height to the second height, from the first communication path 223 toward the central portion RC.

Moreover, according to the first embodiment, the height to which the plurality of feeding paddles 70 projects from the rotating shaft 24*a* in the radial direction gradually decreases within a range from the axially central portion RC of the developer carrier to the second communication path 224, as shown in FIG. 4 to FIG. 6 (see arrow D62 in FIG. 6). The height of the feeding paddles 70 arranged between the spiral blades gradually decreases from the axially central portion RC of the developing roller 21 to a conveying-directional downstream side of the second stirring screw 24. This allows toner positioned in an area in the second conveying path 222 opposite to the central portion RC to be quickly conveyed to the second communication path 224 side. As a result, a sufficient amount of toner can be conveyed to the downstream side of the second conveying path 222 even by the second stirring screw 24 with the plurality of feeding paddles 70 arranged thereon to relatively degrade the axial conveying performance. Furthermore, toner conveyed to the downstream side of the second conveying path 222 in the conveying direction thereof can be effectively pushed out toward the first conveying path 221 via the second communication path 224. The configuration of the feeding paddles 70 may also be described as follows. The height of one of the plurality of feeding paddles 70 located closest to the central portion RC is set equal to the second height. The height of the feeding paddle 70 located closest to the second communication path 224 is set equal to a third height smaller than the second height. The height of the plurality of feeding paddles 70 is set to gradually decrease from the second height to the third height, from the central portion RC toward the second communication path 224.

Figure 7:
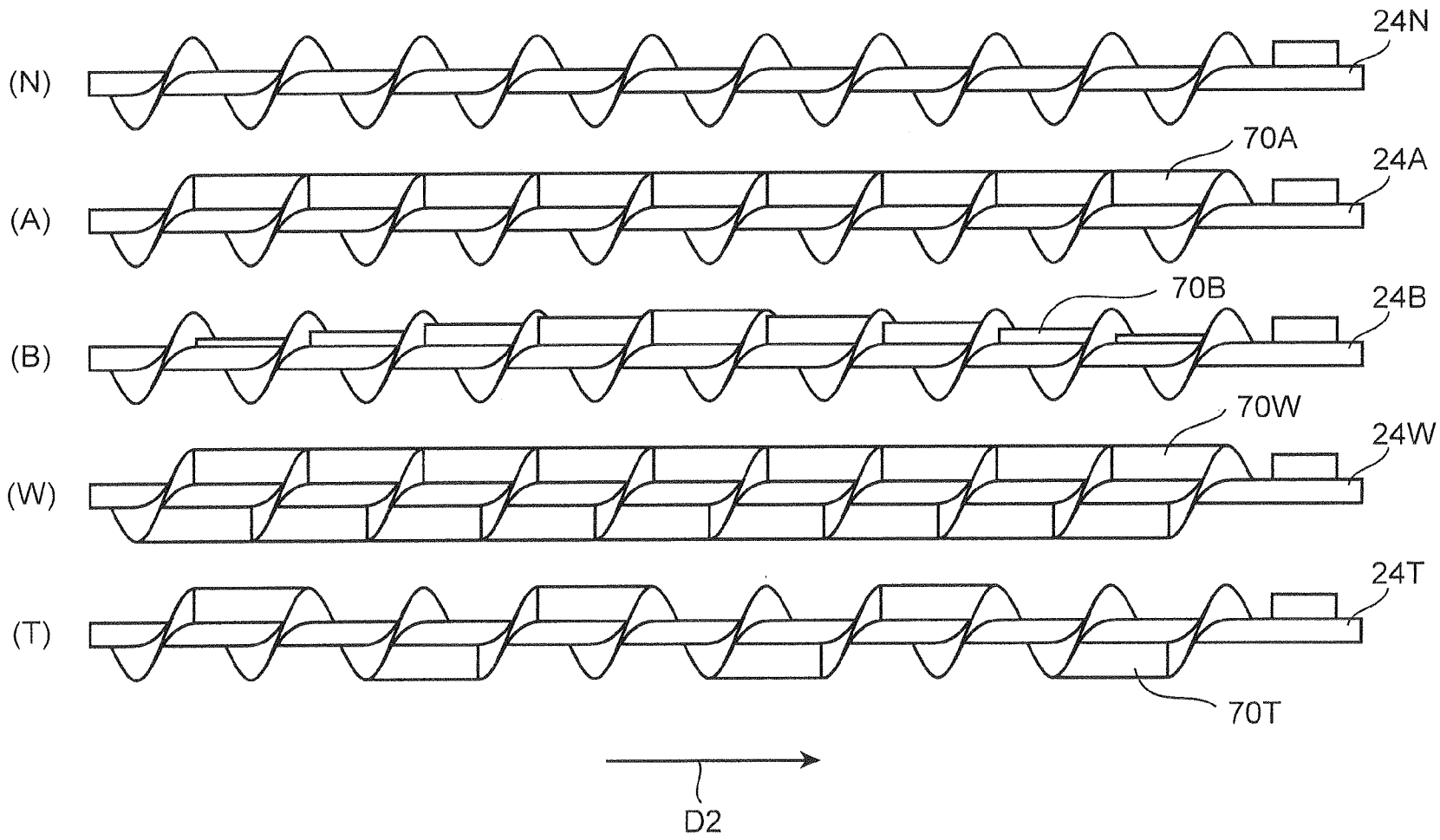
FIG. 7 is a plan view of the first stirring screw according to the embodiment of the present disclosure, a first stirring screw according to another embodiment of the present disclosure, and another stirring screw to be compared with the stirring screws according to the present disclosure.

Now, a second stirring screw 24A with feeding paddles 70A according to a second embodiment will be described. FIG. 7 is a plan view of each stirring screw illustrating experimental conditions for examples described below. The second stirring screw 24A according to the second embodiment is shown at a shape (A) in FIG. 7. The second stirring screw 24A is different from the second stirring screw 24 according to the first embodiment in the shape of the feeding paddles 70A. Thus, this difference will be described below, with the description of the remaining part of the configuration omitted.

Similarly to the abovementioned the feeding paddles 70, the feeding paddles 70A are a plurality of plate-like members (paddle members) projecting in a radial direction from a rotating shaft of the second stirring screw 24A at one circumferential position on the rotating shaft. Furthermore, the feeding paddles 70A are contiguously arranged so as to cover at least an axial area of the rotating shaft corresponding to the image formation area IA of the developing roller 21 (see FIG. 4) and connecting axially adjacent spiral blades of the second stirring screw 24A together. According to the second embodiment, the height to which the plurality of feeding paddles 70A projects in the radial direction from the rotating shaft of the second stirring screw 24A is constant along the axial direction. In such a configuration, the amount of toner fed from the second stirring screw 24A to the developing roller 21 is further inhibited from varying depending on the pitch of the spiral blades of the second stirring screw 24A.

EXAMPLES

Now, the present disclosure will be described based on examples. However, the present disclosure is not limited by the examples described below. The examples use the following experimental conditions.

<Experimental Conditions>

Photosensitive drum 31: OPC drum

Peripheral velocity of the photosensitive drum 31: 146 mm/sec

Layer regulating gap G: 0.3 mm

Development bias AC component: rectangular wave amplitude of 1.7 kV and a duty of 50%

Development bias DC component: 270 V

Surface potential of the photosensitive drum 31 (background portion/image portion): 430 V/30 V Diameter of the developing roller 21: 16 mm Diameter of the photosensitive drum 31: 24 mm Average particle size of magnetic toner: 6.8 μm (D50)

<Shape of the Second Stirring Screw>

FIG. 7 is a plan view showing the second stirring screw used in experiments. A shape (N) in FIG. 7 is a plan view of a second stirring screw 24N that is a comparative example to be compared with examples according to the present disclosure. The second stirring screw 24N includes no feeding paddle 70 according to the present disclosure. Furthermore, a shape (A) in FIG. 7 is a plan view of the second stirring screw 24A according to the second embodiment, which is an example according to the present disclosure. Additionally, a shape (B) in FIG. 7 is a plan view of a second stirring screw 24B with the same configuration as that of the second stirring screw 24 according to the first embodiment, which is an example according to the present disclosure. In addition, a shape (W) in FIG. 7 is a plan view of a second stirring screw 24W that is a comparative example to be compared with the examples according to the present disclosure. The second stirring screw 24W includes feeding paddles 70W contiguously arranged in an axial direction of the second stirring screw 24W at two circumferential positions. Furthermore, a shape (T) in FIG. 7 is a plan view of a second stirring screw 24T that is a comparative example to be compared with the examples according to the present disclosure. The second stirring screw 24T includes feeding paddles 70T alternately arranged along the axial direction of the second stirring screw 24T at two circumferential positions.

Using developing devices with the respective second stirring screws installed therein, experiments were carried out in an environment with a temperature of 30° and a humidity of 70% in which the fluidity of toner is likely to be degraded. In the experiments, evaluations were made in terms of three points: lateral density unevenness, image loss, and vertical streak level.

Table 1 shows results for lateral density unevenness and image loss obtained under the respective experimental conditions. For the lateral density unevenness, printed halftone images are evaluated for a difference in density (ID difference) between areas corresponding to axially opposite end portions of the developing roller 21. The density difference is desirably at least 0.2 or less. Furthermore, the image loss is a phenomenon in which, during consecutive printing of an image pattern with a high coverage rate, toner fails to cover the entire axial area of the second stirring screw, making the image partly blank particularly on the downstream side of the second stirring screw in the conveying direction thereof. A sign o is indicative of a state with approximately no image loss. A sign A is indicative of a state in which a very small image loss has occurred but presents no problem in a practical use. A state in which an image loss has occurred is denoted by sign x. Furthermore, Table 1 shows evaluations for image losses having occurred when 100 sheets were consecutively printed at different coverage rates.

TABLE 1

| Screw specifications | Lateral density difference | Image loss 5% | 20% | 50% | 100% |
|---|---|---|---|---|---|
| (N) No paddle | 0.21 | ○ | ○ | ○ | x |
| (A) One-A | 0.08 | ○ | ○ | ○ | Δ |
| (B) One-B | 0.11 | ○ | ○ | ○ | ○ |
| (W) Two | 0.07 | ○ | ○ | x | x |
| (T) Alternate | 0.23 | ○ | ○ | ○ | ○ |

As shown in Table 1, in the shapes (N) and (T) in the comparative examples, the density difference was large and 0.20 or more. On the other hand, in the shapes (A) and (B) in the examples according to the present disclosure, the density difference was 0.11 or less and was smaller than in the comparative examples. In the shapes (A) and (B), the paddle shapes of the feeding paddles 70 (70A and 70B) on the upstream and downstream sides of the second stirring screw in the conveying direction thereof were symmetric with respect to the axially central portion RC of the developing roller 21. Thus, toner was evenly fed to the developing roller 21, keeping the lateral density difference rating suitable.

Furthermore, as shown in Table 1, an image loss occurred in the shapes (N) and (W) in the comparative examples at high coverage rates. This is because, in the shape (N), the lack of the feeding paddle 70 excessively increases the developer conveying performance in the axial direction, resulting in a reduced amount of toner contained around the second stirring screw. On the other hand, in terms of the image loss, the shapes (A) and (B) in the examples according to the present disclosure, posed no problem in a practical use. The reason is as follows. As described above, in the shapes (A) and (B), the paddle shapes of the feeding paddles 70 (70A and 70B) of the second stirring screw were symmetric with respect to the central portion RC. Thus, toner was evenly fed to the developing roller 21 in the axial direction.

Figure 8:
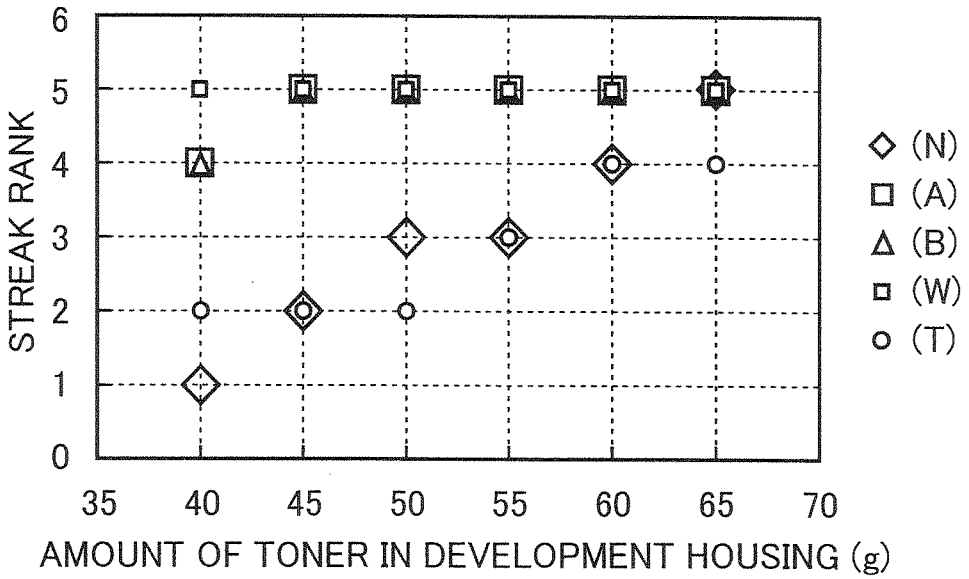
FIG. 8 is a graph showing the results of evaluation for a streak rank observed when the amount of toner in a development housing is varied.

Furthermore, the vertical streak is an image defect occurring on an image due to a locally varying amount of toner fed to the developing roller 21. In the experiments, halftone images on sheets were evaluated for the vertical streak. FIG. 8 shows results for the rank of vertical streaks observed under each experimental condition when the amount of toner in the development housing 210 was varied. For the vertical streak rank, visual evaluations were made on a scale of 1 to 5. The vertical streak rank increases from rank 1 to rank 5, and rank 3 or higher is desirable in a practical use. As shown in FIG. 8, the shapes (A) and (B) in the examples according to the present disclosure maintained a suitable vertical streak rank compared to the comparative example. That is, the provision of the feeding paddles 70 (70A and 70B) made the amount of toner fed to the developing roller 21 even in the axial direction, suitably suppressing generation of vertical streaks.

Figure 9A:
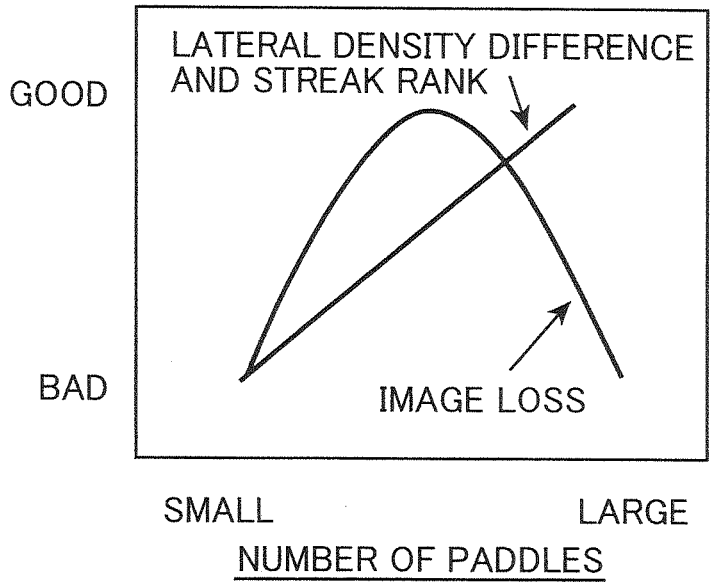
FIG. 9A and FIG. 9B are schematic diagrams showing the effects of the number and arrangement of paddles on lateral density difference, streak rank, and image loss.
Figure 9B:
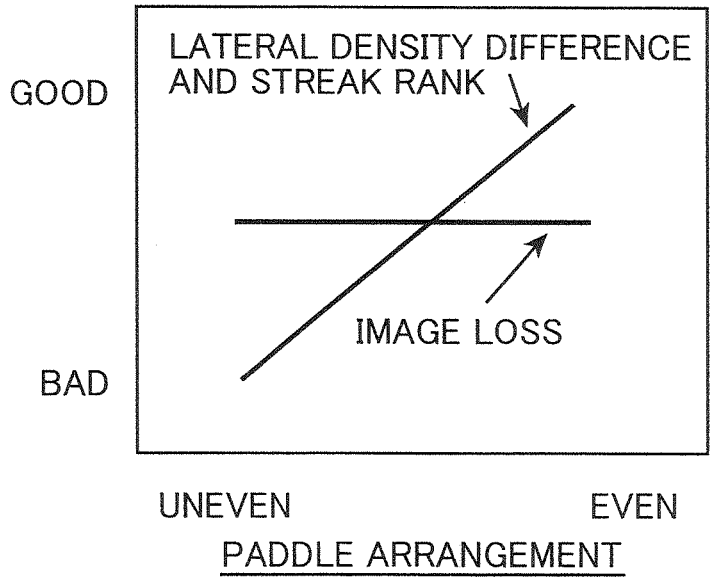

The result of the above is indicated in FIG. 9 showing the effects, on the lateral density difference, streak rank, and image loss, of the number of feeding paddles provided in the circumferential direction and the axial arrangement of the feeding paddles. As shown in FIG. 9A, when the number of feeding paddles is smallest, that is, when no feeding paddle is arranged, the rating lowers for all the evaluation items. As the number of feeding paddles provided in the circumferential direction increases from one to two or more, the lateral density difference rating and the streak rank improve. However, feeding paddles provided at two circumferential positions (the shape (W) in FIG. 7) lead to the shortage of toner on the downstream side of the second stirring screw in the conveying direction thereof, resulting in an image loss. Feeding paddles arranged at one circumferential position increase the amount of toner contained in the second conveying path 222 and inhibit the possible shortage of toner on the downstream side of the second stirring screw 24 in the conveying direction thereof. On the other hand, with reference to FIG. 9B, a case where the feeding paddles are contiguously arranged in the axial direction of the second stirring screw (even) is compared with a case where the feeding paddles are alternately arranged in the axial direction (uneven). In this case, the contiguity of the feeding paddles exerts only a minor adverse effect in terms of the image loss. However, the axially alternately arranged feeding paddles (the shape (T) in FIG. 7) lower the lateral density difference rating and the streak rank.

As described above, in the second stirring screw 24 (24A or 24B) in which the feeding paddles 70 (70A or 70B) are arranged at one circumferential position and in which the projection heights of the paddles on the upstream and downstream sides of the second stirring screw 24 in the conveying direction thereof are symmetric with respect to the central portion RC of the developing roller 21, the lateral density difference, the streak rank, and the image loss rating are stably maintained.

Now, based on these results, the second stirring screw 24 with the feeding paddles 70 according to the first embodiment will be described below in a supplementary manner with reference to FIG. 4. In the vicinity of the first communication path 223 and the second communication path 224 in the development housing 210, the toner is delivered from one path to another and is likely to cause clogging. Even in this case, the reduced projection height of the feeding paddles 70 on the upstream side of the second stirring screw 24 in the conveying direction (second direction) thereof facilitates movement of the toner in the second direction to inhibit the toner from stagnating near the first communication path 223. Furthermore, the reduced projection height of the feeding paddles 70 on the downstream side of the second stirring screw 24 in the conveying direction (second direction) thereof facilitates the flow of the toner through the second communication path 224 to inhibit the toner from stagnating near the second communication path 224.

Moreover, in the embodiments, the toner supply port 25 is arranged on the downstream side of the first conveying path 221 in the conveying direction thereof as shown in FIG. 4. Thus, the conveying path from the toner supply port 25 to the developing roller 21 is relatively short. In this case, the fed toner is stirred for a reduced time, possibly resulting in toner fogging on an image. In particular, toner fogging is most likely to occur at the upstream end portion of the second conveying path 222, from which the toner is fed to the developing roller 21 earliest. Even in this case, when the feeding paddles 70 on the upstream side of the second stirring screw 24 in the conveying direction thereof have a reduced projection height to increase the axial conveying performance as shown in FIG. 4, possible toner fogging is distributed toward the downstream side. This hinders the toner fogging from posing a visual problem.

Furthermore, during consecutive printing of an image with a high coverage rate, the amount of supply toner fails to keep up with the amount of consumed toner, and an image loss such as a partly blank image is likely to occur in association with the downstream end portion of the second stirring screw 24. Even in this case, when the feeding paddles 70 have a gradually decreasing projection height from the central portion RC of the developing roller 21 to the downstream side to increase the toner conveying performance, movement of the toner toward the downstream side of the second stirring screw 24 is facilitated to suppress the image loss.

Moreover, the feeding paddles 70 are arranged along the axial direction so as to cover the image formation area IA of the developing roller 21 to reduce the unevenness of toner feeding between a portion of the second stirring screw 24 with the spiral blade and a portion of the second stirring screw 24 without the spiral blade. Furthermore, in a two-axis toner stirring configuration including the first stirring screw 23 and the second stirring screw 24, the toner is most likely to be collected in areas where the first communication path 223 and the second communication path 224, respectively, are arranged. Moreover, the amount of toner is likely to gradually run short from the upstream end portion of the second stirring screw 24 toward the axially central portion. Even in this case, when the projection height of the feeding paddles 70 is set to gradually increase from the upstream side of the second stirring screw 24 toward the central portion RC, the flow of the toner at the upstream end portion can be accelerated in the axial direction and decelerated near the central portion RC. As a result, an even amount of toner can be distributed around the second stirring screw 24 at the upstream end portion, where much toner is likely to be collected, and near the central portion RC, where the toner is most unlikely to be collected. Thus, the toner is more evenly fed to the developing roller 21. Moreover, when the projection height of the feeding paddles 70 gradually decreases from the central portion RC to the downstream end of the second stirring screw 24, toner clogging can be prevented at the downstream end portion. This allows an even amount of toner to be distributed all over the second stirring screw 24 in the axial direction thereof. As a result, the toner is evenly fed to the developing roller 21, inhibiting possible unevenness or streaks on an image.

According to the first and second embodiments, the amount of developer (the amount of toner) fed from the second stirring screw 24 to the developing roller 21 is inhibited from varying depending on the pitch of the spiral blade. Furthermore, since the plurality of feeding paddles 70 is arranged at one circumferential position on the rotating shaft 24*a* of the second stirring screw 24, this configuration restrains the axial conveying performance of the second stirring screw 24 from excessively decreasing compared to a configuration in which a plurality of paddle members is arranged in the circumferential direction. Thus, the developer is stably fed to the developing roller 21 along the second direction. Moreover, even for a magnetic one-component developer (magnetic toner) having lower fluidity than a two-component developer, the stirring force of the plurality of feeding paddles 70 allows the magnetic toner to be stably stirred and fed to the developing roller 21.

Descriptions have been provided which relate to the developing device with the second stirring screw 24, 24A, or 24B arranged therein and including the feeding paddles 70, 70A, or 70B according to the present disclosure as well as the image forming apparatus including the developing device. However, the present disclosure is not limited to the developing device and the image forming apparatus. The present disclosure can include variations illustrated below.

(1) In the embodiments, the aspect has been described in which, between the spiral blades of the second spiral blade 24*b* of the second stirring screw 24, the outer edge of each of the feeding paddles 70 extends in the axial direction of the second stirring screw 24. However, the present disclosure is not limited to this aspect. The outer edge of the feeding paddle 70 may be arranged in an inclined manner between the spiral blades.

Figure 10A:
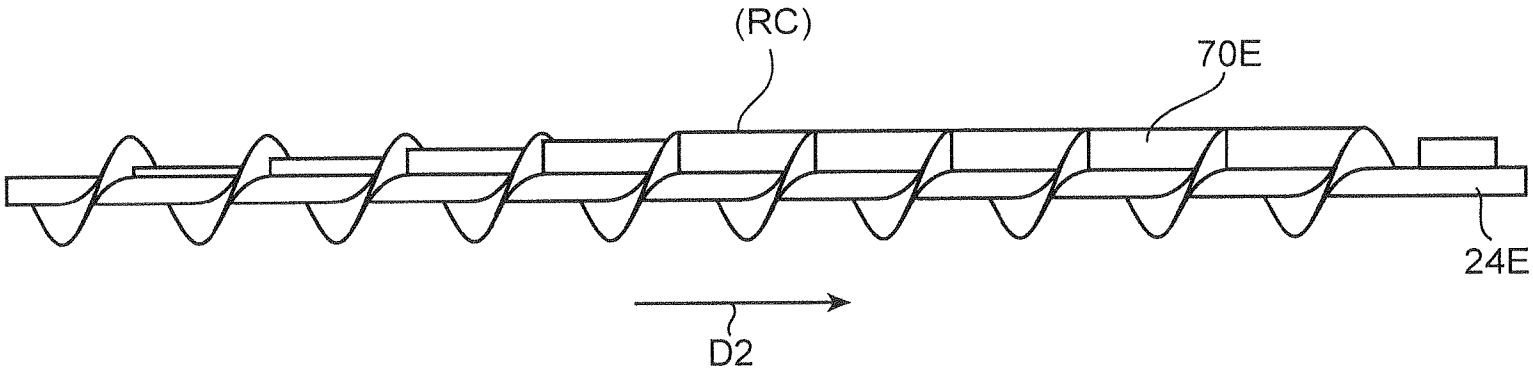
FIG. 10A and FIG. 10B are plan views of the first stirring screw according to a variation of the present disclosure.

(2) Furthermore, in the first embodiment, the aspect has been described in which the projection height of the feeding paddles 70 gradually decreases from the central portion RC to the downstream end portion of the second stirring screw 24. However, the present disclosure is not limited to this aspect. FIG. 10A is a plan view of a second stirring screw 24E and FIG. 10B is a plan view of a second stirring screw 24F according to a variation of the present disclosure.

Feeding paddles 70E are arranged on the second stirring screw 24E shown in FIG. 10A. In the second stirring screw 24E, the projection height of the feeding paddles 70E gradually increases from a second-directional (the direction of arrow D2 in FIG. 10) upstream side of the second stirring screw 24 to an area corresponding to the axially central portion RC of the developing roller 21. Then, the projection height is constant from the area opposite to the central portion RC to a second-directional downstream side of the second stirring screw 24. Even in this configuration, the developer is stably conveyed in the axial direction toward the axially central portion RC of the developing roller 21. Furthermore, the variation further inhibits the amount of developer fed from the second stirring screw 24 to the developing roller 21 in the downstream side portion of the second conveying path 222 from varying depending on the pitch of the spiral blade.

Figure 10B:
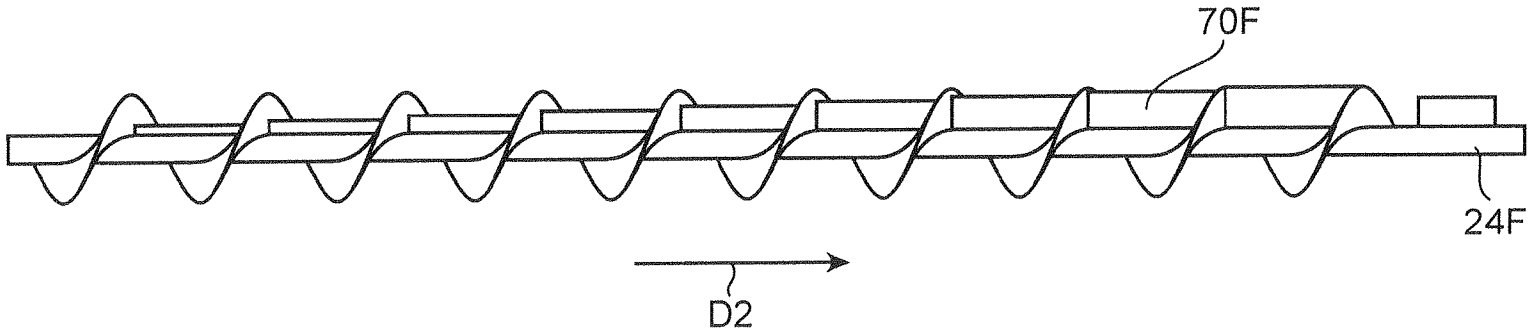

Feeding paddles 70F are arranged on the second stirring screw 24F shown in FIG. 10B. In the second stirring screw 24F, the projection height of feeding paddles 70F gradually increases from an upstream side to a downstream side of the second stirring screw 24 in the second direction thereof. Even in this configuration, the amount of developer fed from the second stirring screw 24 to the developing roller 21 is inhibited from varying depending on the pitch of the spiral blade. Additionally, the developer is stably conveyed from the upstream side to the downstream side of the second conveying path 222, leading to the stable feeding of the developer to the developing roller 21. In other words, a height to which one of the plurality of feeding paddles 70F located on the most upstream side in the second direction projects in a radial direction from the rotating shaft is set equal to a fourth height. The height of the feeding paddle 70F located on the most downstream side in the second direction is set equal to a fifth height larger than the fourth height. The height of the plurality of feeding paddles 70F is set to gradually increase from the fourth height to the fifth height in the second direction.

(3) Furthermore, in the embodiments, the aspect has been described in which the magnetic one-component developer is adopted. However, the present disclosure is not limited to this aspect. An aspect may be used in which a developing device adopting a two-component developer includes the feeding paddles 70 on the second stirring screw 24. In this case, the stirring force of the plurality of feeding paddles 70 allows toner and carrier to be stably stirred and fed to the developing roller 21. Moreover, the present disclosure may be applied to an aspect in which the developing roller 21 carries a two-component developer and in which a touchdown developing device is used including a toner carrying roller (not shown in the drawings) located opposite the developing roller 21. The developing roller 21 feeds the toner to the toner carrying roller, which then carries and feeds the toner to the photosensitive drum 31. Even in this case, the second stirring screw 24 with the feeding paddles 70 stably feeds the two-component developer to the developing roller 21.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device comprising:

a housing containing a developer;

a developer carrier arranged in the housing and rotationally driven to carry the developer on a circumferential surface of the developer carrier;

a developer conveying path having a first conveying path which is disposed in the housing at distance from the developer carrier and through which the developer is conveyed in a first direction and a second conveying path which is disposed between the first conveying path and the developer carrier along the developer carrier and through which the developer is conveyed in a second direction opposite to the first direction, the developer being cyclically conveyed between the first conveying path and the second conveying path;

a developer conveying member disposed in the second conveying path and having a rotating shaft and spiral blades formed around the rotating shaft at a predetermined pitch in an axial direction of the rotating shaft, the developer conveying member being rotationally driven to convey the developer in the second direction and feeding the developer to the developer carrier;

a plurality of paddle members projecting in a radial direction from the rotating shaft of the developer conveying member at one circumferential position on the rotating shaft and contiguously arranged in the axial direction of the rotating shaft to connect the spiral blades adjacent to each other in the axial direction;

a first communication path through which the developer is delivered from the first conveying path to the second conveying path; and a second communication path through which the developer is delivered from the second conveying path to the first conveying path, wherein within a range from the first communication path to an axially central portion of the developer carrier, a height to which one of the plurality of paddle members located closest to the first communication path projects in the radial direction from the rotating shaft is set equal to a first height, the height of the paddle member located closest to the central portion is set equal to a second height larger than the first height, and the height of the plurality of paddle members is set to gradually increase from the first height to the second height, from the first communication path toward the central portion, and within a range from the axially central portion of the developer carrier to the second communication path, the height of the paddle member located closest to the second communication path is set equal to a third height lower than the second height, and the height of the plurality of paddle members are set to gradually decrease from the second height to the third height, from the central portion toward the second communication path.

2. The developing device according to claim 1, wherein the developer is a two-component developer composed of toner and a carrier.

3. The developing device according to claim 1, wherein the developer is magnetic toner.

4. The developing device according to claim 2, further comprising:

a toner carrier carrying toner on a circumferential surface thereof, wherein the developer carrier receives the two-component developer from the developer conveying member and feeds the toner contained in the two-component developer to the toner carrier.

5. An image forming apparatus comprising:

an image carrier on which an electrostatic latent image is formed and which carries a toner image resulting from visualization of the electrostatic latent image by means of the developer;

a developing device which feeds the developer to the image carrier; and a transfer device which transfers an image from the image carrier to a sheet, wherein the developing device includes:

a housing containing a developer;

a developer carrier arranged in the housing and rotationally driven to carry the developer on a circumferential surface of the developer carrier;

a developer conveying path having a first conveying path which is disposed in the housing at a distance from the developer carrier and through which the developer is conveyed in a first direction and a second conveying path which is disposed between the first conveying path and the developer carrier along the developer carrier and through which the developer is conveyed in a second direction opposite to the first direction, the developer being cyclically conveyed between the first conveying path and the second conveying path;

a developer conveying member disposed in the second conveying path and having a rotating shaft and spiral blades formed around the rotating shaft at a predetermined pitch in an axial direction of the rotating shaft, the developer conveying member being rotationally driven to convey the developer in the second direction and feeding the developer to the developer carrier;

a plurality of paddle members projecting in a radial direction from the rotating shaft of the developer conveying member at one circumferential position on the rotating shaft and contiguously arranged in the axial direction of the rotating shaft to connect the spiral blades adjacent to each other in the axial direction a first communication path through which the developer is delivered from the first conveying path to the second conveying path; and a second communication path through which the developer is delivered from the second conveying path to the first conveying path, wherein within a range from the first communication path to an axially central portion of the developer carrier, a height to which one of the plurality of paddle members located closest to the first communication path projects in the radial direction from the rotating shaft is set equal to a first height, the height of the paddle member located closest to the central portion is set equal to a second height larger than the first height, and the height of the plurality of paddle members is set to gradually increase from the first height to the second height, from the first communication path toward the central portion, and within a range from the axially central portion of the developer carrier to the second communication path, the height of the paddle member located closest to the second communication path is set equal to a third height lower than the second height, and the height of the plurality of paddle members are set to gradually decrease from the second height to the third height, from the central portion toward the second communication path.

6. The image forming apparatus according to claim 5, wherein the developer is a two-component developer composed of toner and a carrier.

7. The image forming apparatus according to claim 5, wherein the developer is magnetic toner.

8. The image forming apparatus according to claim 6, further comprising:

a toner carrier carrying toner on a circumferential surface thereof, wherein the developer carrier receives the two-component developer from the developer conveying member and feeds the toner contained in the two-component developer to the toner carrier.

9. The image forming apparatus according to claim 5, further comprising:

a developer container storing a developer supplied to the developing device, wherein the developing device includes:

a developer supply port formed in the housing above a downstream side of the first conveying path in the first direction and loading the developer from the developer container into the first conveying path.

10. The image forming apparatus according to claim 9, wherein the developing device includes:

a conveying capability suppressing section located downstream of the developer supply port in the first direction and having developer conveying performance in which developer conveying performance of the developer conveying member is partly suppressed.

11. A developing device comprising:

a housing containing a developer;

a developer carrier arranged in the housing and rotationally driven to carry the developer on a circumferential surface of the developer carrier;

a developer conveying path having a first conveying path which is disposed in the housing at distance from the developer carrier and through which the developer is conveyed in a first direction and a second conveying path which is disposed between the first conveying path and the developer carrier along the developer carrier and through which the developer is conveyed in a second direction opposite to the first direction, the developer being cyclically conveyed between the first conveying path and the second conveying path;

a developer conveying member disposed in the second conveying path and having a rotating shaft and spiral blades formed around the rotating shaft at a predetermined pitch in an axial direction of the rotating shaft, the developer conveying member being rotationally driven to convey the developer in the second direction and feeding the developer to the developer carrier; and a plurality of paddle members projecting in a radial direction from the rotating shaft of the developer conveying member at only one circumferential position on the rotating shaft and contiguously arranged in the axial direction of the rotating shaft to connect the spiral blades adjacent to each other in the axial direction.

* * * * *